US009912073B2

(12) United States Patent
Anderson et al.

(10) Patent No.: US 9,912,073 B2
(45) **Date of Patent: *Mar. 6, 2018**

(54) RIDGED WAVEGUIDE FLARED RADIATOR ANTENNA

(75) Inventors: Joseph M. Anderson, Tucson, AZ (US); Jared W. Jordan, Sahuarita, AZ (US); Charles G. Gilbert, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1162 days.

This patent is subject to a terminal disclaimer.

(21) Appl. No.: 13/457,546

(22) Filed: Apr. 27, 2012

(65) Prior Publication Data

US 2013/0241788 A1 Sep. 19, 2013

Related U.S. Application Data

(60) Provisional application No. 61/611,823, filed on Mar. 16, 2012.

(51) Int. Cl.
*H01Q 21/00* (2006.01)
*H01Q 13/06* (2006.01)
(Continued)

(52) U.S. Cl.
CPC ..... *H01Q 21/0081* (2013.01); *H01Q 13/06* (2013.01); *H01Q 13/085* (2013.01);
(Continued)

(58) Field of Classification Search
CPC .... H01Q 13/0283; H01Q 21/00; H01P 11/00; H01P 5/107
(Continued)

(56) References Cited

U.S. PATENT DOCUMENTS 4,063,248 A * 12/1977 Debski et al. ..... 343/727
4,427,984 A * 1/1984 Anderson ..... 343/764
(Continued)

FOREIGN PATENT DOCUMENTS

FR 2 691 014 11/1993
WO WO 02/052674 A1 7/2002

OTHER PUBLICATIONS

Bell, et al., "A Low-Profile Archimedean Spiral Antenna Using an EBG Ground Plane;" IEEE Antennas and Wireless Propagation Letters; vol. 3; Jul. 2004; pp. 223-226.
(Continued)

*Primary Examiner* — Daniel J Munoz
(74) *Attorney, Agent, or Firm* — Daly, Crowley, Mofford & Durkee, LLP

(57) ABSTRACT

Presently disclosed is an antenna system having an array of ridged waveguide Vivaldi radiator (RWVR) antenna elements fed through a corporate network of suspended air striplines (SAS). The SAS transfers the electromagnetic energy to the radiating element via the ridged waveguide coupler. The Vivaldi radiator matches the output impedance of the ridged waveguide coupler/SAS to the impedance of the surrounding medium. Because the coupling method and the radiating elements are wideband mediums, this antenna array is capable of wideband operation. The physical dimensions of the resulting array are also not as sensitive to its electrical performance as other antenna designs since the bandwidth is quite large, reducing the occurrence of an out-of-specification antenna due to manufacturing tolerance build-up. This also reduces the complexity of the manufacturing process, which in turn lowers cost.

20 Claims, 5 Drawing Sheets

(51) Int. Cl.
*H01Q 13/08* (2006.01)
*H01Q 15/00* (2006.01)

(52) U.S. Cl.
CPC ..... *H01Q 15/006* (2013.01); *H01Q 15/008* (2013.01); *H01Q 21/0087* (2013.01); *Y10T 29/49016* (2015.01)

(58) Field of Classification Search
USPC ..... 343/771, 841
See application file for complete search history.

(56) References Cited

U.S. PATENT DOCUMENTS

| | | | | |
|---|---|---|---|---|
| 5,264,860 | A * | 11/1993 | Quan | 343/767 |
| 5,361,049 | A | 11/1994 | Rubin et al. | |
| 5,506,589 | A | 4/1996 | Quan et al. | |
| 6,052,889 | A * | 4/2000 | Yu et al. | 29/600 |
| 6,175,337 | B1 | 1/2001 | Jasper, Jr. et al. | |
| 6,271,799 | B1 * | 8/2001 | Rief et al. | 343/776 |
| 6,545,647 | B1 | 4/2003 | Sievenpiper et al. | |
| 6,952,190 | B2 | 10/2005 | Lynch et al. | |
| 7,307,596 | B1 * | 12/2007 | West | 343/778 |
| 7,522,105 | B1 | 4/2009 | LaComb | |
| 2004/0233112 | A1 * | 11/2004 | Aisenbrey | 343/700 MS |
| 2007/0224737 | A1 | 9/2007 | Berlin et al. | |
| 2009/0303128 | A1 | 12/2009 | Robert et al. | |
| 2011/0050527 | A1 | 3/2011 | Anderson et al. | |

OTHER PUBLICATIONS

Chun, et al.; "Modeling and Characterization of Cavity Backed Circular Aperture Antenna With Suspended Stripline Probe Feed;" IEEE Antennas and Propagation Society International Symposium; vol. 2; Jul. 16-21, 2000; pp. 774-777.

Rammos; "A New Wideband, High Gain Suspended Substrate Line Planar Array for 12 GHz Satellite T.V.;" Microwave Conference; 13th European; IEEE; Sep. 3, 1983; pp. 227-231.

PCT Search Report of the ISA for PCT/US2012/067587 dated Apr. 18, 2013.

Written Opinion of the ISA for PCT/US2012/067587 dated Apr. 18, 2013.

PCT Search Report of the ISA for PCT/US2012/067582 dated Apr. 23, 2013.

Written Opinion of the ISA for PCT/US2012/067582 dated Apr. 23, 2013.

Bell et al.: "A Low-Profile Archimedean Spiral Antenna Using an EGB Ground Plane; IEEE Antennas and Wireless Propagation Letters," vol. 3, Issue 1; Dec. 2004; pp. 223-226.

Palmer:"Intellectual Ventures Invents Beam-Steering Metamaterials Antenna:" IEEE Inside Technology Spectrum; http://spectrum.ieee.org/telecom/wireless/intellectual-ventures-invents-beamsteering-metamaterials-antenna/?utm_source=techalert&utm_medium=email&utm_campaign=120111; Jan. 2012; 2 pages.

Anderson et al.; "Ridged Waveguide Flared Radiator Array Using Electromagnetic Bandgap Material;" U.S. Appl. No. 13,457,547, filed Apr. 27, 2012; 32 pages.

Lai, et al.; "Infinite Wavelength Resonant Antennas with Monopolar Radiation Pattern Based on Periodic Structures;" IEEE Transactions on Antennas and Propagation; vol. 55; No. 3; Mar. 2007; pp. 868-876.

Response to Office Action dated May 2, 2014 for U.S. Appl. No. 13/457,547, filed Apr. 27, 2012.

Department of the Navy; "Naval Shore Electronics Criteria;" Installation Standards and Practices; Navelex 0101,110; Chapter 13; Jun. 1972; 31 pages.

Whitaker; "The Electronics Handbook;" CRC Press; A CRC Handbook Published in Cooperation with IEEE Press; Chapter 20; 1996; 12 pages.

Office Action dated Jan. 30, 2014, U.S. Appl. No. 13/457,5476, filed Apr. 27, 2012, pp. 1-22.

Notice of Allowance for Application No. 12 799 472.1-1812 dated Apr. 14, 2015.

Notice of Allowance for Application No. 12 816 164.3-1812 dated Apr. 13, 2015.

Notification Concerning Transmittal of International Preliminary Report on Patentability (Chapter I of the Patent Cooperation Treaty), PCT/US2012/067587, dated Sep. 25, 2014, 6 pages.

Notification Concerning Transmittal of International Preliminary Report on Patentability (Chapter I of the Patent Cooperation Treaty), PCT/US2012/067582, dated Sep. 25, 2014, 6 pages.

Response to Final Office Action dated Jul. 14, 2014, U.S. Appl. No. 13/457,547, filed Oct. 14, 2014, 18 pages.

* cited by examiner

RIDGED WAVEGUIDE FLARED RADIATOR ANTENNA

GOVERNMENT LICENSE RIGHTS

This invention was made with Government support under N00024-07-C-5432 awarded by the Naval Sea Systems Command. The Government has certain rights in the invention.

CROSS-REFERENCE TO RELATED APPLICATIONS

This application CLAIMS PRIORITY to U.S. Provisional Ser. No. 61/611,823, filed on Mar. 16, 2012, which is incorporated herein by reference in its entirety.

BACKGROUND

This invention relates to the manufacture and structure of a radio frequency antenna, specifically one for use in a compact array.

An antenna radiates or receives energy. A radio frequency (RF) antenna for use in a microwave radar radiates or receives energy in the radio frequency range that is typically 1-20 GHz (gigahertz), but may be higher or lower. The RF antenna may be structured to radiate or receive energy over a broad bandwidth or a narrow bandwidth. RF antennas are widely used in military applications such as aircraft and missile guidance.

In a compact antenna array, the RF energy needed to excite the individual radiating elements originates from a single transmitter. The energy is then distributed to all the elements through the antenna feed network. To have the antenna operate across a wide instantaneous bandwidth, the feed network often uses a corporate architecture with matched four port power dividers (one port is terminated in a matched load) performing the RF power distribution. Such corporate feed structures are well known in the art.

A number of designs of RF antennas are also well known. Many are based upon microwave waveguide principles, in which a waveguide directs energy in a selected direction and radiates the energy outwardly into free space (or equivalently, receives energy radiated through free space).

The radiating elements may include conventional waveguides, waveguide horns, and various other forms. In most applications, the operational bandwidth of a waveguide or waveguide horn is considered to be the range of electromagnetic waves that can propagate within the waveguide as a single fundamental mode or a pair of orthogonal fundamental modes. The addition of conductive ridges in the walls of a waveguide (typically referred to as a "ridged waveguide" or RWG) is known to increase the bandwidth of the waveguide.

The principal known techniques for fabricating RF antennas include foil forming, dip brazing, and electroforming of metallic-based structures. Individual antenna elements are fastened to the feed structure by mechanical fasteners, adhesives, or solders. Mechanical fasteners are time-consuming to install. Adhesives typically require careful application and curing at elevated temperature for an extended period of time. Solders are sometimes difficult to use, especially when there is an attempt to achieve precision alignment of soldered structures. Additionally, all of these techniques result in a relatively heavy antenna structure, which is undesirable in a flight-worthy vehicle.

A typical compact antenna design, such as that used in seekers, direction finding, or aircraft, strives to accomplish are high gain, large bandwidth, ease of manufacturability and low cost. Current state of the art struggles to accomplish all of the above in one design. One prior art example of a solution to this problem is found in U.S. Pat. No. 6,052,889, to Yu, et al., (Yu '889) incorporated herein by reference in its entirety. In that apparatus, the inventors addressed the problems by fabricating the antenna elements by first injection molding a group of broadband radio frequency radiating elements from a polymeric material, metalizing each broadband radio frequency radiating element, and installing a transmission line within each broadband radio frequency radiating element. While this design provides excellent performance, it requires a complicated manufacturing process.

Thus, there is a need for an improved approach to the design and fabrication of RF antennas that reduces both cost and weight of the antenna, and is compatible with either broadband or narrow band applications.

SUMMARY

In contrast to the above-described conventional approaches, embodiments of the present antenna system are directed to an array of ridged waveguide Vivaldi radiator (RWVR) antenna elements fed through a corporate network of suspended air striplines (SAS). In some embodiments, each antenna element is fed by a SAS, which transfers the electromagnetic energy to the Vivaldi radiator via the ridged waveguide coupler. The Vivaldi radiator gradually matches the output impedance of the ridged waveguide coupler/SAS to the intrinsic impedance of the surrounding medium.

Because the coupling method and the radiating elements in this design are both wideband mediums, this antenna array is capable of wideband operation. Advantageously, the directivity of an individual RWVR element is relatively large in comparison to other types of array elements such as dipoles or radiating slots.

Also, designing an array with RWVR elements is not limited to resonant element spacing, as is the case with radiating slots from a resonant waveguide, giving the antenna designer another degree of freedom (i.e., modified spacing) to adjust side lobe levels. The physical dimensions of the RWVR array are also not as sensitive to its electrical performance as other antenna designs since its bandwidth is quite large, reducing the occurrence of an out-of-specification antenna due to manufacturing tolerance build-up. This also reduces the complexity of the manufacturing process, which in turn lowers cost.

In accordance with a further aspect of the concepts describe herein, an antenna apparatus, comprising: a suspended air stripline (SAS) disposed in a housing, said SAS having a proximate end and a distal end; a ridged waveguide (RWG) coupler having a proximate end and a distal end, said proximate end of said RWG disposed substantially in an aperture in said housing and coupled thereto, said aperture located above said distal end of said SAS; and one or more radiating elements coupled to the distal end of said RWG, wherein said one or more radiating elements are configured to couple electromagnetic energy from the proximate end of said SAS, through said RWG, and into free space.

With this particular arrangement, a compact, versatile, and simplified antenna is provided. The antenna may employ one or more radiating elements or more specifically, one, two, or four elements. The antenna may comprise a corporate feed network coupled to said proximate end of said SAS. In some exemplary embodiments, said SAS, said RWG, and said one or more radiating elements are each configured to optimally transmit electromagnetic signals in at least one of the C, X, Ku, and Ka-band. In some exemplary embodiments, the one or more radiating elements may comprise a Vivaldi radiator, a flared radiator, a horn radiator, or a spiral radiator. In still another exemplary embodiment, the radiating elements and/or the RWG may be comprised of a conductive material such as (but without limitation) a polymer. In still another exemplary embodiment, the radiating elements and/or the RWG may be comprised of a non-conductive material such as (but without limitation) a polymer that has a conductive surface coating.

In some embodiments of the concepts, systems, and techniques disclosed herein, the one or more radiating elements and said RWG may be monolithically formed. In some embodiments, the antenna may be a receive antenna, a transmit antenna, or be configured to both receive and transmit electromagnetic energy.

In accordance with a still further aspect of the concepts described herein, a method of communicating with electromagnetic energy representing information, comprising: furnishing a suspended air stripline (SAS) disposed in a housing, said SAS having a proximate end and a distal end; furnishing a ridged waveguide (RWG) coupler having a proximate end and a distal end, said proximate end of said RWG disposed substantially in an aperture in said housing and coupled thereto, said aperture located above said distal end of said SAS; attaching one or more radiating elements coupled to the distal end of said RWG; and coupling a supplied electromagnetic energy from the proximate end of said SAS, through said RWG, and into free space to communicate said information represented thereby.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The term "forward" is used herein to describe a direction towards the radiating aperture of an antenna, and the terms "back" and "backward" is used to describe the opposing direction. The forward end of an element is in the forward direction and the back end of an element is in the backward direction.

Figure 1:
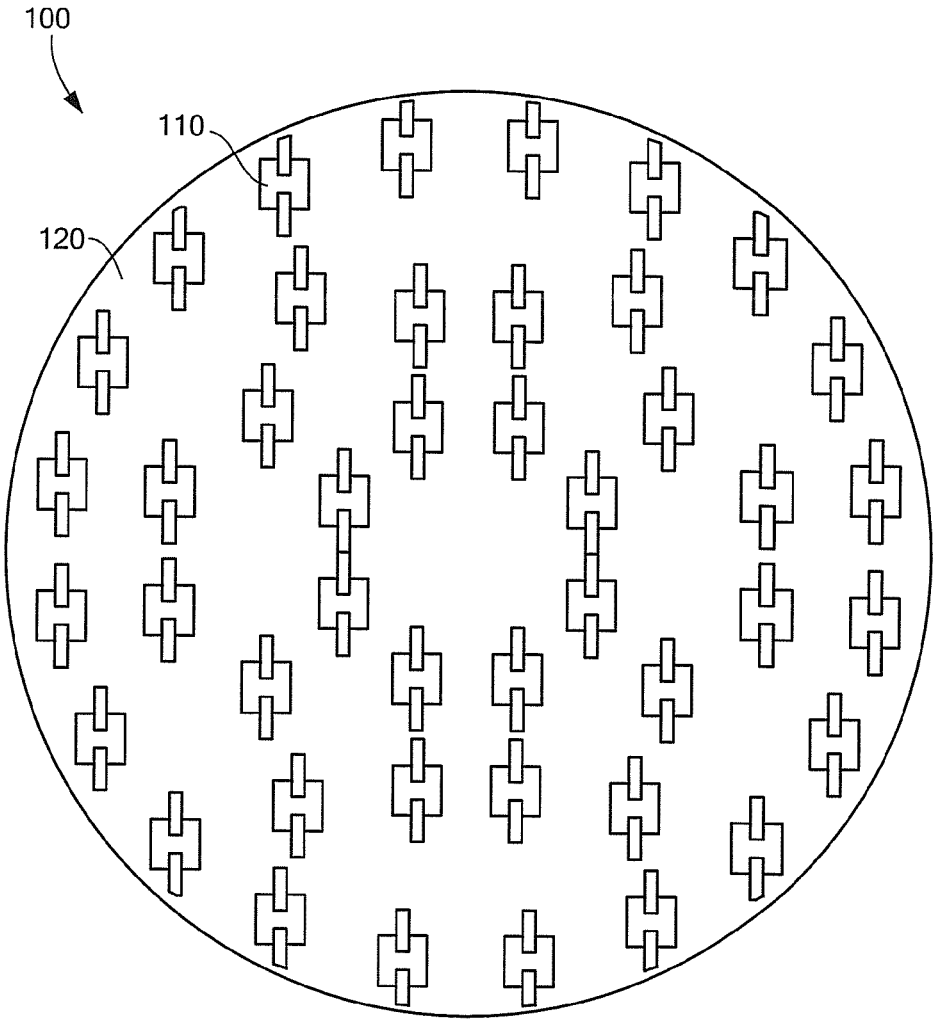
FIG. 1 is a diagram of the face of an array of ridged waveguide Vivaldi radiators (RWVR) antenna elements, according to one embodiment of the present invention.

Embodiments of the present apparatus are directed to an array of ridged waveguide Vivaldi radiator (RWVR) antenna elements fed by a corporate network of suspended air striplines (SAS), such as the configuration shown in FIG. 1. Here, array 100 is comprised of a plurality of RWVR elements 110 mounted (by conventional means) on substrate 120. (The suspended air striplines and the conventional corporate feed network connecting them are not visible in this view.)

Figure 2:
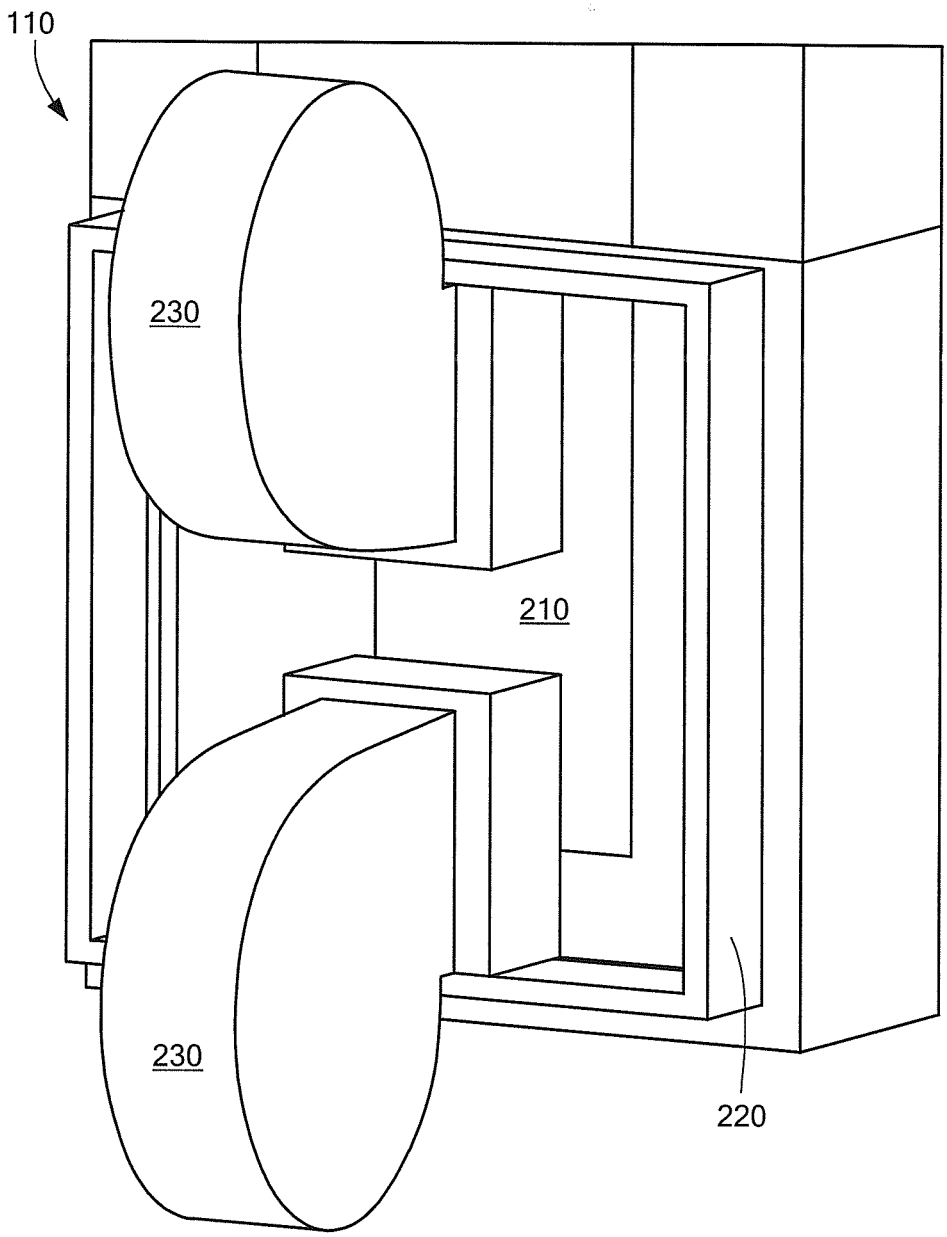
FIG. 2 is an expanded view of a RWVR antenna element, according to one embodiment of the present invention.

A detailed view of a RWVR antenna element 110 can be seen in FIG. 2. Each antenna element 110 is fed by a SAS 210. The SAS transitions the electromagnetic energy via a ridged waveguide coupler 220 to one or more conventional Vivaldi radiators 230. As is well known in the antenna arts and as used herein, the term ridged waveguide refers to a variation of a rectangular waveguide having a single or double ridge protruding into the waveguide from the broad faces of the rectangular waveguide and Vivaldi radiators 230 gradually match the output impedance of the ridged waveguide coupler 220 to the intrinsic impedance of the medium surrounding the radiators (typically free space). Coupling from the feed network (not shown) and SAS from the cavity into the ridged waveguide coupler 220 and finally to the radiators 230 is accomplished by electromagnetic (EM) coupling.

Although a well-known Vivaldi radiator is described, those skilled in the art will realize that known RF radiating structures and devices, other than a Vivaldi radiator, can be used. For example, a horn radiator, patch radiator, or the like may also be employed to radiate electromagnetic energy into the surrounding media, which may be free space. Accordingly, the concepts, systems, and techniques described herein are not limited to any particular type of radiator.

Referring to FIG. 2, each RWVR antenna element 110 has the same configuration with a generally parallelepiped, hollow ridged waveguide coupler 220 and a pair of ear-like arms (i.e., the Vivaldi radiators 230) extending outwardly from the outer face of coupler 220 in a direction generally perpendicular to the substrate 120 (as depicted in FIG. 1). In some embodiments, coupler 220 and Vivaldi radiators 230 may be machined or otherwise formed by conventional means from any suitable conductive material, including (without limitation) any of the metals or metal alloys commonly in use in the RF component arts or yet to be discovered.

Alternatively, coupler 220 and Vivaldi radiators 230 may be, taken together, of a one-piece construction, preferably prepared by injection molding a polymeric material into a die cavity defining the shape of the body and the ear-like arms. An important economy is achieved by making the broadband radio frequency radiating elements of one-piece construction, rather than two-piece or multiple-piece construction.

When employed, the polymeric material is most preferably glass-fiber-reinforced polyetherimide (PEI). In such an embodiment, the entire outer surface of each broadband radio frequency radiating element is coated with an electrically conductive metallization coating. Coating is preferably accomplished by electroless deposition of copper, gold, or silver to a thickness of at least about 0.0015 inches. (No such coating is required when the antenna element is machined or otherwise constructed of a conductive material.)

In a further alternate embodiment, coupler 220 and Vivaldi radiators 230 may be formed as a single piece of a conductive polymer or a part formed from molded plastic or the like that is then conductively plated through means well known in the art.

One of ordinary skill in the art will immediately recognize that the above alternate partitioning of the components of the RWVR element 110 into functional components does not necessarily imply that the functional components are physically separable or separately fabricated. Various alternate embodiments and methods of manufacture are with within the skills of an ordinary practitioner.

In contrast with other approaches, this approach requires no additional components other than ridged waveguide coupler 220 and Vivaldi radiators 230. Use is made of the ridged waveguide's TE10 mode as a coupling mechanism rather than the coaxial mode employed in the prior art (such as, for example, Yu '889).

Figure 3:
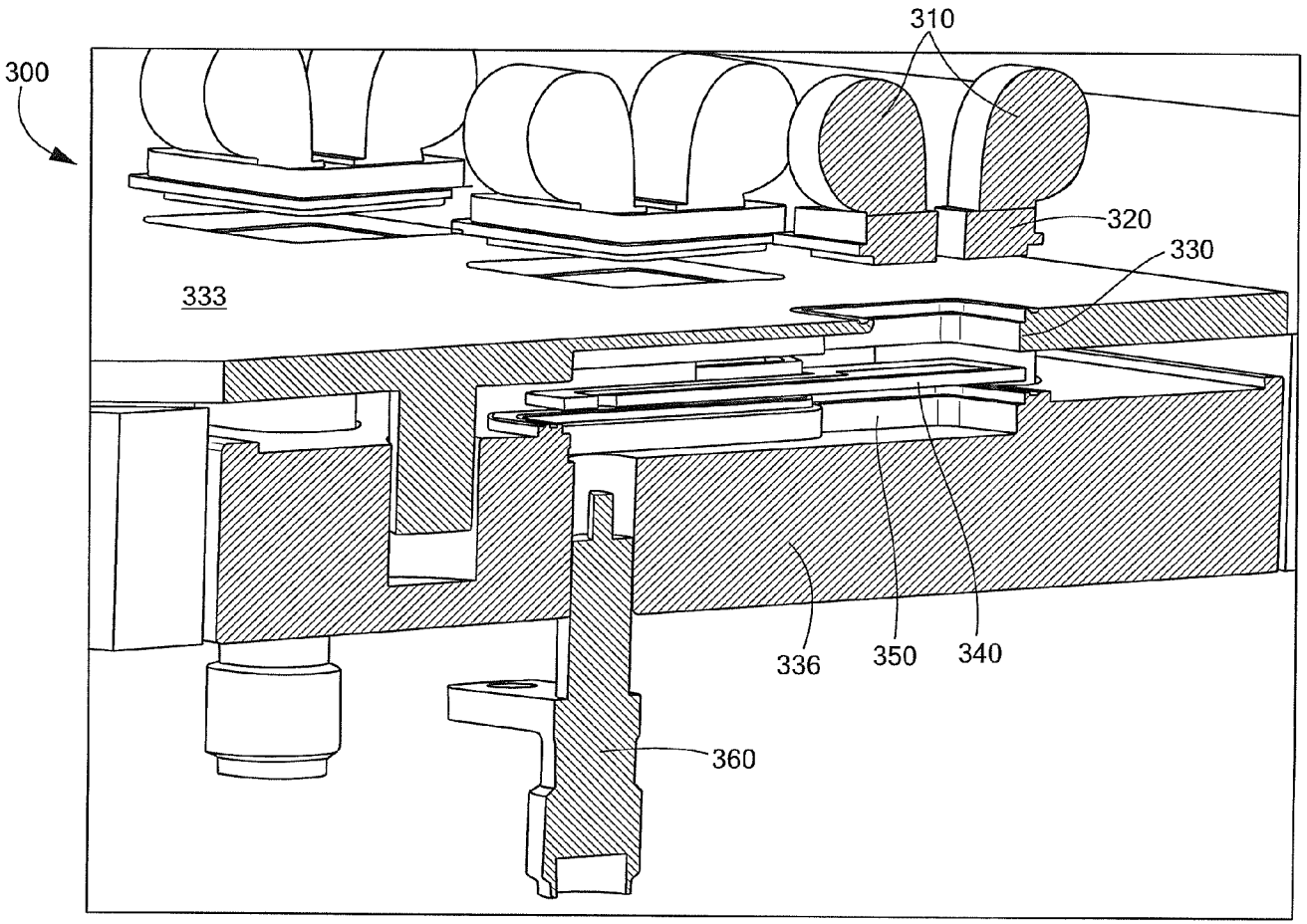
FIG. 3 is an exploded assembly view of one exemplary embodiment of a RWVR element within an array.

FIG. 3 depicts an exploded section view of the components of an antenna element constructed as part of a representative array 300. As noted above, Vivaldi radiators 310 may be formed as a part of ridged waveguide coupler 320 (or vice versa). Alternatively, these parts may be formed separately and joined together by any of a number of means well known in the art.

Although two Vivaldi radiators 310 are described, those skilled in the art will realize that a single Vivaldi radiator may be used in beam-shaping applications. Likewise, multiple radiators (e.g., four radiators located 90° apart) may be used in other applications. Accordingly, the concepts, systems, and techniques described herein are not limited to any particular number or type of radiators.

Ridged waveguide coupler 320 fits into opening 330 in substrate 333, which in turn acts as a cover for baseplate 336, thereby defining a cavity 350 therebetween. SAS 340 is mounted in cavity 350, again using conventional means. Preferably, the separation between the top surface of SAS 340 and the bottom-most surface of ridged waveguide 320, when assembled, is about 0.020 inches (20 mils). Variations in spacing and dimensions adjusted to optimize the operation of the element at various frequencies are well-within the knowledge of one of ordinary skill in the art; accordingly, further discussion of such variants is not warranted.

In some embodiments, an exemplar of which is shown in FIG. 3, SAS 340 is fed by a conventional SMA connector 360, which may be soldered or otherwise conventionally attached to SAS 340. Such a configuration may be useful for testing and characterization, or for simple arrays of directly-driven elements. In a preferred embodiment, SAS 340 is driven by a conventional corporate stripline feed network (not shown).

Figure 4:
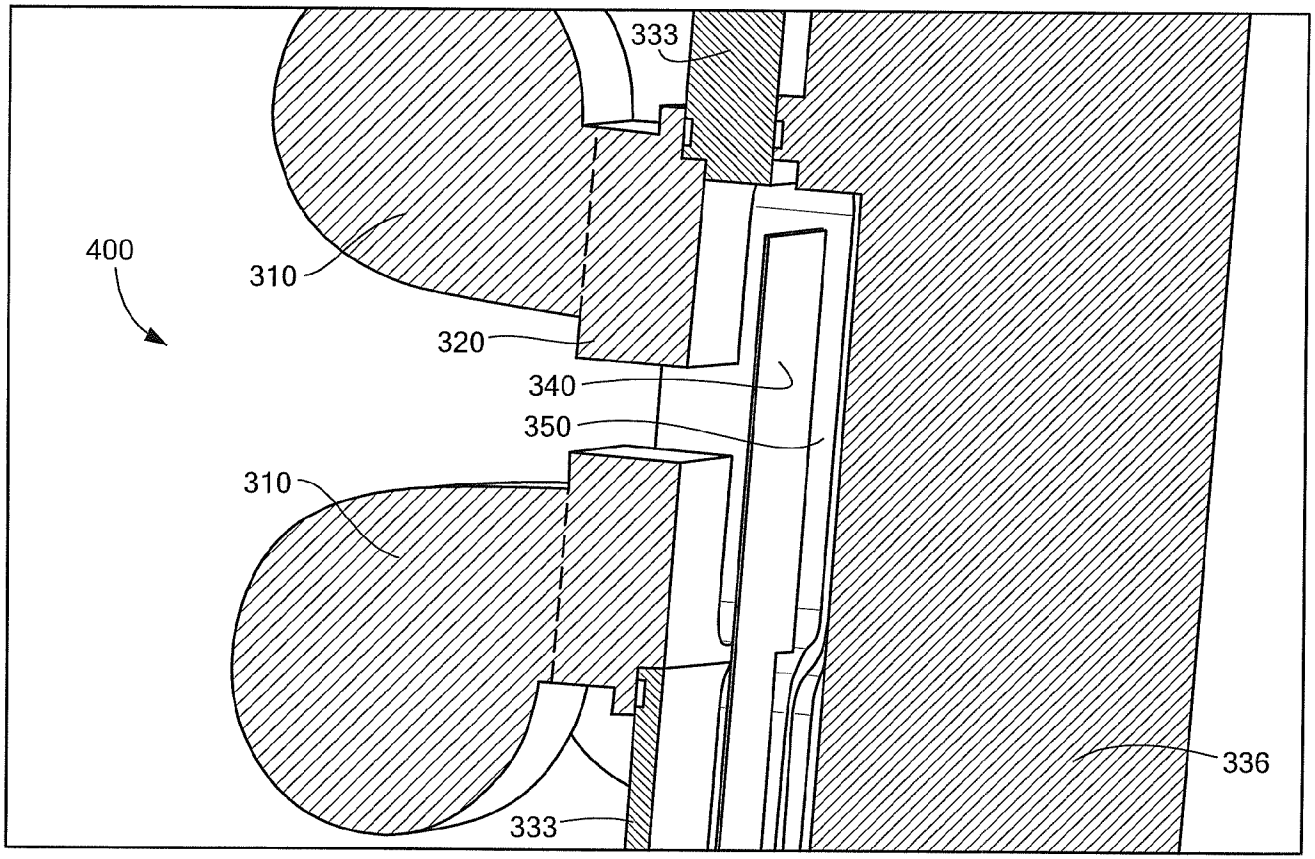
FIG. 4 is a cross-sectional view of the RWVR assembly, according to one embodiment of the present invention.

FIG. 4 shows an assembled antenna element 400 in cut-away detail. As in FIG. 3, radiators 310 are mounted to ridged waveguide coupler 320, shown in partial section. Ridged waveguide coupler 320 is in turn mounted in opening 330 (shown, for clarity, in FIG. 3 only) of substrate 333. Cavity 350, enclosing SAS 340, is thus formed by ridged waveguide 320, substrate 333, and baseplate 336.

Figure 5B:
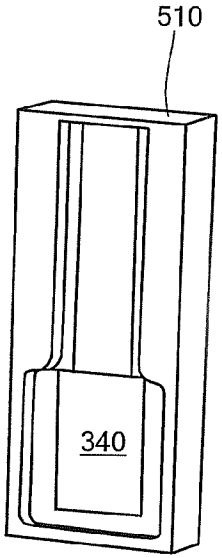
FIG. 5B is a close-up view of a suspended air stripline mounted within the cavity, according to one embodiment of the present invention.
Figure 5A:
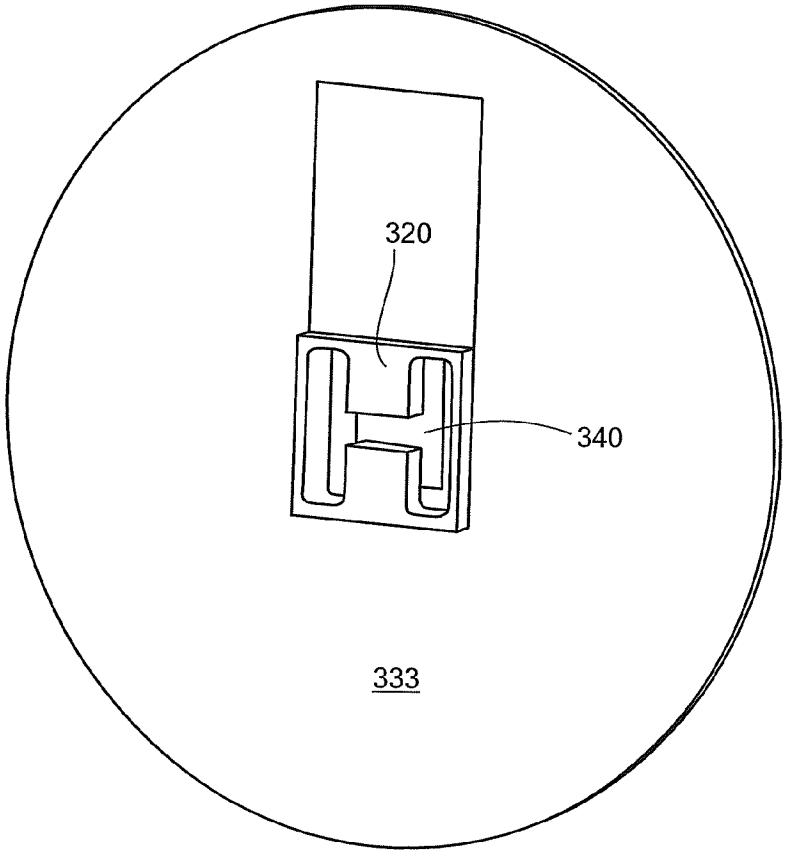
FIG. 5A is a detail view of a ridged waveguide coupler mounted on a substrate, as employed in an exemplary embodiment.

FIG. 5A depicts ridged waveguide coupler 320 mounted in and on substrate 333. SAS 340 is shown below and partially obscured by ridged waveguide coupler 320. FIG. 5B depicts suspended air stripline 340 inside enclosure 510, which may be formed as cavity 350 (referring to FIGS. 3 and 4) in baseplate 336 or, alternatively, as a separate structure mounted on the back side of substrate 333.

The foregoing has discussed the RWVR elements as being mounted on and through a substrate 333, which in turn acts as a cover to baseplate 336. However, one of ordinary skill in the art will appreciate that the cover/baseplate assembly make take any form and may consist of one or multiple pieces suitably configured to support the RWVR elements in whatever array format (and within any form factor) necessary. Accordingly, the support structure or housing shown is for illustration only and need not limit the configuration of an RWVR array.

A particular advantage of this apparatus is that the assembly only requires the radiator subassembly 310/320 to be mounted (for example, but not by way of limitation, by using common epoxy techniques) into opening 330 of substrate 333 in order to achieve the desired performance. The need for coaxial connections, additional piece parts, and complex assemblies are eliminated.

An array's bandwidth can be severely limited by the coupling between the corporate feed structure and the elements, and/or by the elements themselves. The coupling method and the radiating elements in this design are both wideband mediums; therefore, the antenna array produces wideband results.

Another benefit of the RWVR array is its large directivity. The directivity of an individual RWVR element is relatively large in comparison to other array elements such as dipoles or radiating slots.

The physical dimensions of the RWVR array are not as sensitive to its electrical performance as other antenna designs since its bandwidth is quite large, reducing the occurrence of an out-of-specification antenna. This also reduces the complexity of the manufacturing process, which in turn lowers cost.

Designing an array from RWVR elements is not limited to resonant element spacing, as is the case with radiating slots from a resonant waveguide, giving the antenna designer another degree of freedom to adjust side lobe levels. Here, the dimensions of the Vivaldi radiator and the ridged waveguide coupler may be determined using conventional design techniques given the required bandwidth (including both the low band and the high band) and desired gain for the antenna element or array.

Antennas constructed according to the concepts, systems, and techniques disclosed herein may be designed and simulated using a software tool adapted to solve three-dimensional electromagnetic field problems. The software tool may be a commercially available electromagnetic field analysis tool such as CST Microwave Studio™, Agilent's Momentum™ tool, or Ansoft's HFSS™ tool. The electromagnetic field analysis tool may be a proprietary tool using any known mathematical method, such as finite difference time domain analysis, finite element method, boundary element method, method of moments, or other methods for solving electromagnetic field problems. The software tool may include a capability to iteratively optimize a design to meet predetermined performance targets. Accordingly, the operating frequency and/or bandwidth of the present apparatus is not limited to any particular region, but is only constrained by the physical properties of the assembly as designed.

Although a RWVR element and array of RWVR elements is described in the context of receiving electromagnetic energy in general, and RF signals in particular, those skilled in the art will recognize that such apparatus is equally capable of transmitting as well. Accordingly, the concepts, systems, and techniques described herein are not limited to receive antennas, but may include transmit antennas, bi-directional antennas, monopulse or other tracking systems, radars, and the like without limitation.

Figure 6:
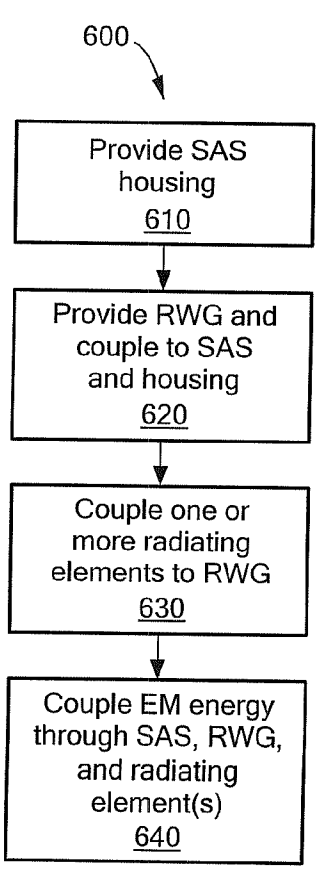
FIG. 6 is a flowchart of a method of communicating with a RWVR array according to one embodiment of the present invention.

The concepts, systems, and techniques discussed above may also be expressed in terms of a method of communicating with electromagnetic energy representing information. Such a process 600 may comprise, in one exemplary embodiment, of the steps described with regard to FIG. 6.

In step 610, a suspended air stripline (SAS) is provided, where the SAS has a proximate end and a distal end. The SAS may be enclosed (in whole or in part, without limitation) by a housing. The proximate end of the SAS may be fed, as above, from a corporate feed structure.

In step 620, a ridged waveguide (RWG) coupler is provided. The RWG coupler has a proximate end and a distal end. The proximate end of the RWG is mounted (through conventional means, without limitation) in an aperture in the SAS housing and electrically and mechanically coupled thereto. The housing's aperture is located above the distal end of the SAS.

In step 630, one or more radiating elements, such as (without limitation) a Vivaldi radiator, are coupled to the distal end of the RWG.

Finally, in step 640, electromagnetic (EM) energy (i.e., radio waves, RF signals, or the like, without limitation) is coupled from the proximate end of the SAS, through said RWG, and into free space to communicate the information represented by the electromagnetic energy or signals.

In an alternate embodiment of step 640, the EM energy may be received energy, as that conventional term is understood. In such embodiments, the EM energy is incident on the radiating elements and coupled thence through the RWG and to the SAS before leaving the apparatus through the corporate feed structure.

The order in which the steps of the present method are performed is purely illustrative in nature. In fact, the steps can be performed in any order or in parallel, unless otherwise indicated by the present disclosure.

As used herein, "plurality" means two or more. As used herein, a "set" of items may include one or more of such items. As used herein, whether in the Detailed Description or the Claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first," "second," "third," etc., to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

While particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

We claim:

1. An antenna, comprising:

a suspended air stripline (SAS) disposed in a housing, said SAS having a proximate end and a distal end;

a ridged waveguide coupler having a proximate end and a distal end, said proximate end of said ridged waveguide coupler disposed substantially in an aperture in said housing and coupled thereto, said aperture located above said distal end of said SAS; and one or more radiating elements coupled to the distal end of said ridged waveguide coupler, wherein said one or more radiating elements are configured to couple electromagnetic energy from the proximate end of said SAS, through said ridged waveguide coupler, and into free space.

2. The antenna of claim 1, wherein said one or more radiating elements comprise a number of elements selected from the group consisting of one, two, and four.

3. The antenna of claim 1, further comprising a corporate feed network coupled to said proximate end of said SAS.

4. The antenna of claim 1, wherein said SAS, said ridged waveguide coupler, and said one or more radiating elements are each configured to optimally transmit electromagnetic signals in at least one of the C, X, Ku, and Ka-band.

5. The antenna of claim 1, wherein said one or more radiating elements comprise a Vivaldi radiator.

6. The antenna of claim 1, wherein said one or more radiating elements comprise a flared radiator.

7. The antenna of claim 1, wherein said one or more radiating elements comprise a horn radiator.

8. The antenna of claim 1, wherein said one or more radiating elements comprise a spiral radiator.

9. The antenna of claim 1, wherein at least one of said one or more radiating elements and said ridged waveguide coupler are comprised of a conductive material.

10. The antenna of claim 1, wherein at least one of said one or more radiating elements and said ridged waveguide coupler are comprised of a conductive polymer.

11. The antenna of claim 1, wherein at least one of said one or more radiating elements and said ridged waveguide coupler are comprised of a non-conductive polymer with a conductive surface coating.

12. The antenna of claim 1, wherein said one or more radiating elements and said ridged waveguide coupler are monolithically formed such that, when taken together, said one or more radiating elements and said ridged waveguide coupler are of a one piece construction.

13. The antenna of claim 1, wherein said antenna is a receive antenna.

14. The antenna of claim 1, wherein said antenna is a transmit antenna.

15. The antenna of claim 1, wherein said antenna is configured to both receive and transmit electromagnetic energy.

16. A method of communicating with electromagnetic energy representing information, comprising:

furnishing a suspended air stripline (SAS) disposed in a housing, said SAS having a proximate end and a distal end;

furnishing a ridged waveguide coupler having a proximate end and a distal end, said proximate end of said ridged waveguide coupler disposed substantially in an aperture in said housing and coupled thereto, said aperture located above said distal end of said SAS;

attaching one or more radiating elements coupled to the distal end of said ridged waveguide coupler; and coupling a supplied electromagnetic energy from the proximate end of said SAS, through said ridged waveguide coupler, and into free space through use of the ridged waveguide coupler's transverse electric ten ($TE_{10}$) mode as a coupling mechanism and without a coaxial cable between said one or more radiating elements and said SAS to communicate said information represented thereby.

17. The method of claim 16, further comprising furnishing a corporate feed network coupled to said proximate end of said SAS.

18. The method of claim 16, wherein said SAS, said ridged waveguide, and said one or more radiating elements are each configured to optimally transmit electromagnetic signals in at least one of the C, X, Ku, and Ka-band.

19. The method of claim 16, wherein said one or more radiating elements comprise a Vivaldi radiator.

20. An apparatus comprising:

a suspended air stripline (SAS) disposed in a housing, said SAS having a proximal end and a distal end;

a ridged waveguide coupler having a proximal end and a distal end, said proximal end of said ridged waveguide coupler disposed substantially in an aperture in said housing and coupled thereto, said aperture located above said distal end of said SAS;

one or more radiating elements coupled to the distal end of said ridged waveguide coupler; and a connector for coupling a supplied electromagnetic energy to the proximal end of said SAS, such that electromagnetic energy is coupled through said ridged waveguide coupler, and into free space through use of the ridged waveguide coupler's transverse electric ten ($TE_{10}$) mode as a coupling mechanism and without a coaxial cable between said one or more radiating elements and said SAS to communicate said information represented thereby.

* * * * *